United States Patent [19]

Luther

[11] Patent Number: 4,596,340

[45] Date of Patent: Jun. 24, 1986

[54] ADJUSTABLE STORAGE CONTAINER

[76] Inventor: Mark B. Luther, 19340 Devonshire, Birmingham, Mich. 48009

[21] Appl. No.: 743,755

[22] Filed: Jun. 12, 1985

[51] Int. Cl.[4] ..... B65D 8/00; B65D 8/14

[52] U.S. Cl. ..... 220/8

[58] Field of Search ..... 220/8

[56] References Cited

U.S. PATENT DOCUMENTS

| | | | |
|---|---|---|---|
| 193,686 | 7/1877 | Bowers | 220/8 |
| 358,696 | 3/1887 | Reichert | 220/8 |
| 401,493 | 4/1889 | Gundermann | 220/8 |
| 750,632 | 1/1904 | Fisher | 220/8 |
| 825,810 | 7/1906 | Cooke | 220/8 |
| 4,046,279 | 9/1977 | Rosler | 220/8 |

FOREIGN PATENT DOCUMENTS

| | | | |
|---|---|---|---|
| 2024163 | 1/1980 | United Kingdom | 220/8 |

*Primary Examiner*—George E. Lowrance
*Attorney, Agent, or Firm*—Harness, Dickey & Pierce

[57] ABSTRACT

A storage container is formed of a pair of tubes with one fitting telescopically into the other. A row of axially aligned keys protruding from the inner tube fit into a keyway slot in a plurality of annular ribs from the outer tube. The keys can slide through the keyway slot in an axial motion and are also movable circumferentially between an adjacent pair of ribs whereby the two tubes are interlocked at a given length.

9 Claims, 5 Drawing Figures

ADJUSTABLE STORAGE CONTAINER

SUMMARY OF THE INVENTION

The present invention is directed to a storage container comprising of an inner and an outer tube which can be adapted to fit together, one tube telescopically insertable into the other. The one tube consists of a plurality of axially spaced annular ribs protruding toward the inner tube. The ribs define at least one keyway slot at terminating points. The inner tube has a plurality of axially aligned, axially spaced, keys which project toward the outer tube. These keys are movable axially through the keyway slot of the outer tube, allowing the sliding together of both tubes in a telescopical motion. The keys are also movable circumferentially between an adjacent pair of ribs whereby the tubes can be relatively rotated to interlock the keys with the ribs.

The storage container is made up of two cylinderically shaped hollow bodies telescopically insertable one into the other and each hollow body is closed at one end and is open at the other end. In the assembled state one hollow body is locked into the other at a given length. The inner hollow body has a row of keys, circular in cross-section, extending axially for the entire length and the outer hollow body has a plurality of axially spaced annular ribs. In the assembled state the keys of the inner hollow body are protruding toward the outer hollow body and the annular ribs of the outer hollow body are protruding towards the inner hollow body. The outer hollow body has terminating intervals in the annular ribs which define keyway slots where upon asembly of the two hollow bodies the keys of the inner hollow body can slide axially through said keyway slot of the outer hollow body. This telescopical movement can be terminated or locked by rotating circumferentially the two hollow bodies in opposition of each other. The locking is accomplished when the keys of the inner hollow body are movable circumferentially between an adjacent pair of ribs. Upon locking, of the two hollow bodies, the keys of the inner hollow body engage in an enlarged head portion of the ribs at said keyway slot. This increased width of the annular ribs at their terminating intervals, adjacent the keyway slot, provides an interference fit when the keys of the inner hollow body engage between the annular ribs of the outer hollow body. After the keys pass the interference point in the annular ribs there is a reduction of friction between the two hollow bodies.

If objects of different lengths are to be packed in a container so that they perform no or only small axial movements, it is necessary to provide a container adaptable to different lengths. An adjustable container eliminates the use of different containers for different lengths which reduces the costs of different molds or tools needed for production.

There is a Know Packing Container No. 24 31 672 German Utility Model No. 74 22 45 which consists of an inner hollow body and an outer hollow body. The outer hollow body has at least one row of teeth formed on its inner surface extending over its full length while the inner hollow body is provided adjacent its open end on its outer surface with a projection extending over a part of its length and engageable with the row of teeth.

There is a known container which consists of an inner and outer hollow body disclosed in German Utility Model No. 76 20 793. Such a container has locking ribs or teeth which extend over its entire length. The cooperation part at its open end engages with these locking teeth. The locking however, is forced axial movement so that locking occurs at the time of assembly.

The most recent U.S. Pat. No. 4,210,253 related to this subject consists of two hollow bodies which can be screwed together. This invention however does not provide a definite locking system of the two parts since the two parts can be circumferential rotated at infinite increments without any friction point.

Based on this know state of the art, it is recognized that different types of containers exist in accomplishing the packing of objects at different lengths through the adjusting of two hollow bodies in a particular manner. The present invention allows both parts of the container to be easily handled when locking or unlocking is taking place. The keyway slot allows both parts to slide together with minimum friction and the interference fit by rotating the two parts together provides a secure locking of the container when exposed to rough handling. In packing production time is also a factor to be considered. The present invention solves this problem without sacrificing any positive features the other known state of the art provides. Furthermore, the locking of the two parts in the present invention can occur by rotating the two parts circumferentially in either a clockwise or counter-clockwise motion.

The various features of novelty which characterize the invention are defined with particularity in the claims. For a more accurate understanding of this invention, its operating advantages and specific uses it could have, attention should be given to the Drawings.

DETAILED DESCRIPTION OF THE DRAWING

Figure 1:
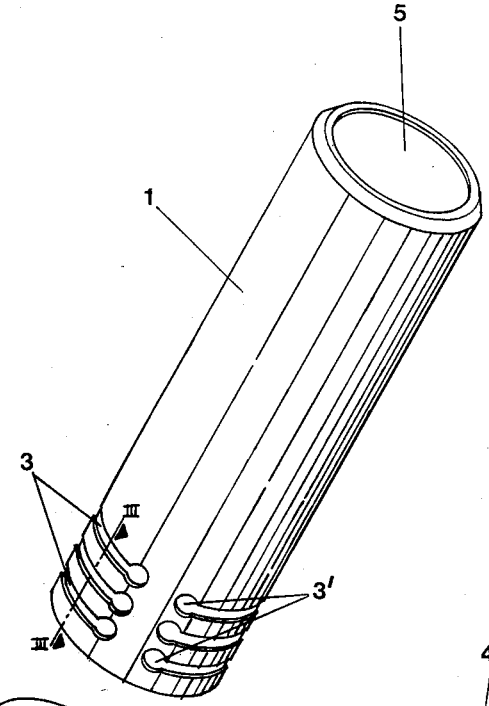
FIG. 1 Is a perspective view of two hollow bodies forming a packaging container with hollow body 2 arranged to extend telescopically into hollow body 1.

In FIG. 1 a packaging container is illustrated formed of an outer hollow body 1 and an inner body 2. Each hollow body has a closed end identical to the other, note closed end 5 of the outer hollow body 1, the closed end of the inner hollow body is not visibile. In FIG. 1 the open ends of each hollow body are shown adjacent to one another so that the inner hollow body 2 can slide telescopically into the outer hollow body 1. In order to accomplish this telescoping feature the inner diameter of the outer hollow body 1 is slightly greater than the outer diameter of the inner hollow body 2.

Figure 2:
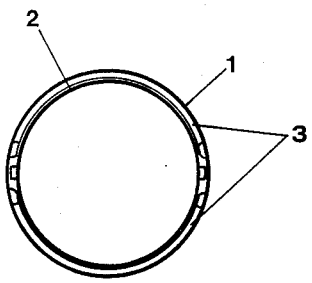
FIG. 2 Is a view showing the open end of hollow body 1 along with a sectional view of of hollow body 2 in the telescoping state of assembly. This view illustrates the formation of the keyway slot adjacent the annular ribs 3 of hollow body 1 and the projection of the circular keys 4 of hollow body 2.
Figure 3:
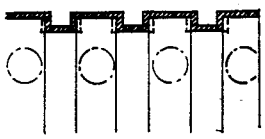
FIG. 3 Is a sectional view taken along the line III—III in FIG. 1, illustrating the cross-secional formation of the annular ribs 3 and the displacement (shown dotted) of the circular keys 4 between the ribs.

As shown in FIG. 1, the inner hollow body 2 has at least one row of keys 4 circular in cross-section which project and extend parallel to the longitudinal axis of the hollow body 2 for its full axial length. The arrangement of hollow body 1 has a plurality of annular ribs 3 which cooperate with the keys 4 of the inner body 2. The configuration of the annular ribs is better recognized in the sectional view of FIG. 3 taken along the line III—III of FIG. 1. FIG. 3 shows how the rings project to the inside surface of the outer body 1 and also illustrates the equally spaced interval from one another. In FIG. 2 a view of the open end of hollow body 1 is seen showing the terminating points in the annular ribs 3 which produce a keyway slot in the cross-sectional diameter. FIG. 1 shows both bodies displaced axially so that the keys 4 can pass through the keyway slot of the annular ribs 3.

The keys 4 of the inner body 2 are at a slightly greater diameter than the interval between the enlarged head portions 3' of the outer body 1, and are at a somewhat smaller diameter than the interval between adjacent annular ribs 3. After telescoping, the bodies are locked by rotating either or both hollow bodies, with respect to their closed ends in a clockwise or counter-clockwise motion. The locking action is accomplished by engaging the keys 4 between the annular rings 3. The locking is made secure by the enlarged head portion at the ends of the annular rings 3'. This part is very important, since the rounded ends of the annular rings 3' guide the projections 4 between the annular rings and also induce an interference fit upon engaging. The interference fit occurs only at the ends of the annular rings 3' which create a smaller distance between the annular rings and upon which the width of the keys 4 is greater than the said distance of the annular rings at their ends 3'. After the point of interference is passed upon the rotation of the two bodies the circular projections 4 are placed between the annular rings 3 and can move freely in this locked position. This locking principle allows the packaging container to have a "snap" feel when being locked or unlocked.

Figure 4:
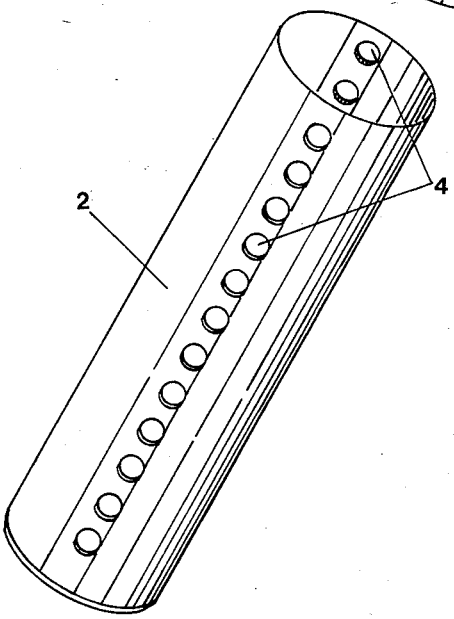
FIG. 4 Is a sectional view taken along the line IV—IV in FIG. 5; showing the protrusion of the keys 4 and a closed end cross-sectional view typical to both hollow bodies.
Figure 4:
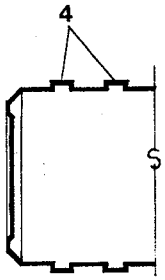

On FIG. 4 a sectional view of the closed end of the inner body 2 is seen. It illustrates the proportion of wall thickness to cylinder diameter and also the relative projection of the keys 4.

Figure 5:
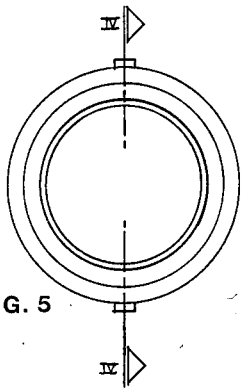
FIG. 5 Is the closed end view of hollow body 2 which is not visible in FIG. 1.

FIG. 5 gives the closed end view of the inner body 2 and explains through section lines IV the sectional view of FIG. 4.

What is claimed is:

1. A container comprising:

inner and outer cylindrical tubes, said inner tube adapted to fit inside the outer tube in telescopic relation;

one of said tubes having a plurality of axially spaced, parallel annular ribs extending partially around the circumference of said one of said tubes and protruding toward the other of said tubes;

said ribs having terminal ends with enlarged heads, axially adjacent heads having an axial space therebetween and circumferentially adjacent heads having a circumferential space therebetween, said circumferential spaces forming at least one axially extending keyway slot;

the other of said tubes having a plurality of axially aligned, axially spaced, keys protruding toward said one tube;

each said circumferential space being larger than the circumferential width of said keys, said keys being movable axially through said keyway slot; and each said axial space being smaller than the axial width of each of said keys, each of said keys being movable with interference circumferentially between a preselected pair of axially adjacent heads to axially interlock said tubes with respect to each other.

2. The invention as defined in claim 1 wherein each of said tubes has a closed end and an open end, said open end of the inner tube being adapted to fit inside the open end of the outer tube.

3. The invention as defined in claim 1 wherein said circumferential spaces define two axially extending keyway slots, said other tube having two sets of said keys, one set being in alignment with one of said keyway slots when the other set is in alignment with the other of said keyway slots.

4. The invention as defined in claim 1 wherein said keys are circular in cross-section.

5. The invention as defined in claim 1 wherein each tube is a unitary body of plastic.

6. The invention as defined in claim 3 wherein said heads are circular in cross-section and each rib has parallel sides extending between the respective heads.

7. The invention as defined in claim 2 wherein said one tube is said outer tube and said other tube is said inner tube.

8. The invention as defined in claim 7 wherein there are three ribs disposed adjacent the open end of said one tube and wherein said keys are axially spaced at intervals corresponding to the spacing between adjacent ribs, said keys being full length of said other tube.

9. A container comprising:

inner and outer cylindrical tubes, each tube comprising a unitary body of plastic, said inner tube adapted to fit inside said outer tube in telescopic relation;

said outer tube having a plurality of axially spaced, parallel ribs extending partially around the circumference of said outer tube and protruding toward said inner tube;

said ribs having terminal ends with enlarged heads circular in cross-section, axially adjacent heads having an axial space therebetween and circumferentially adjacent heads having a circumferential space therebetween, said circumferential spaces forming first and second axially extending keyway slots;

said inner tube having a first plurality of axially aligned, axially spaced keys circular in cross-section and protruding toward said outer tube and a second plurality of axially aligned, axially spaced keys protruding toward said outer tube;

each said circumferential space being larger than the circumferential width of said keys, said first and second plurality of keys being movable axially through said first and second keyway slots respectively; and each said axial space being smaller than the axial width of each of said keys, each of said keys being movable with interference circumferentially between a preselected pair of axially adjacent heads to axially interlock said tubes with respect to each other.

* * * * *